US008875469B1

(12) United States Patent
Keller, Sr.

(10) Patent No.: US 8,875,469 B1
(45) Date of Patent: Nov. 4, 2014

(54) EASILY INSTALLABLE PROTECTIVE SLEEVE FOR AN EMBEDDED WOODEN POST REQUIRING UPLIFT CAPABILITY

(71) Applicant: William R. Keller, Sr., Ephrata, PA (US)

(72) Inventor: William R. Keller, Sr., Ephrata, PA (US)

( * ) Notice: Subject to any disclaimer, the term of this patent is extended or adjusted under 35 U.S.C. 154(b) by 0 days.

(21) Appl. No.: 14/055,326

(22) Filed: Oct. 16, 2013

Related U.S. Application Data

(60) Provisional application No. 61/714,702, filed on Oct. 16, 2012.

(51) Int. Cl.

| | |
|---|---|
| ***E04B 1/00*** | (2006.01) |
| ***E04G 21/00*** | (2006.01) |
| ***E04G 23/00*** | (2006.01) |
| ***E02D 5/60*** | (2006.01) |

(52) U.S. Cl.
CPC ..... *E02D 5/60* (2013.01)
USPC ..... 52/745.12; 52/165; 52/296; 52/297; 52/298; 52/711; 248/346.01; 248/346.04; 256/65.14

(58) Field of Classification Search
USPC ..... 52/155, 166, 165, 170, 296, 297, 295, 52/298, 701, 704, 707, 706, 709, 711, 712, 52/714, 715, 745.15, 745.18, 741.11, 52/741.14, 745.04, 745.12, 169.13, 40, 52/292; 256/31, 65.14; 248/346.01, 530, 248/519, 357, 678, 346.04; 405/259.1
See application file for complete search history.

(56) References Cited

U.S. PATENT DOCUMENTS

| | | | | |
|---|---|---|---|---|
| 3,417,525 | A * | 12/1968 | Dashio | 52/160 |
| 4,939,037 | A * | 7/1990 | Freeman et al. | 428/36.3 |
| 5,315,796 | A | 5/1994 | Gruhlke | |
| 5,320,226 | A | 6/1994 | Merrill | |
| 6,041,559 | A | 3/2000 | Schickert et al. | |
| 6,098,351 | A * | 8/2000 | Mills | 52/169.14 |
| 6,389,760 | B1 | 5/2002 | McDonnell | |
| 6,886,296 | B1 | 5/2005 | John et al. | |
| 7,506,859 | B2 * | 3/2009 | Keller et al. | 256/65.14 |
| 7,827,747 | B2 * | 11/2010 | George et al. | 52/292 |
| 8,082,702 | B2 * | 12/2011 | Hill | 52/155 |
| 8,584,413 | B1 * | 11/2013 | Keller, Sr. | 52/297 |
| 2001/0000548 | A1 | 5/2001 | Niehaus | |

FOREIGN PATENT DOCUMENTS

| | | |
|---|---|---|
| GB | 2364719 A | 6/2002 |
| GB | 2418677 A | 5/2006 |

* cited by examiner

*Primary Examiner* — Chi Q Nguyen
(74) *Attorney, Agent, or Firm* — Andrew D. Mead

(57) ABSTRACT

A sleeve for protecting from deterioration and anchoring an embedded end of a post in the ground. The sleeve, molded from unperforated, resilient material, conforms to the exterior post dimensions and extends for at least the desired embedment distance. One or more inwardly projecting notches are cut into the post. The sleeve includes one or more reversible snap domes molded into the sleeve at locations coinciding with the post notches. The snap domes flex to an outwardly concave position as the post is being inserted into the sleeve and then snap to an inwardly concave position once the post is fully installed and the snap domes align with the notches. The inward concavity of the snap domes extends into and engages the post notches to prevent the sleeve from being removed from the post. When embedded into the ground, backfill material prevents the snap dome from being deflected into the outward concavity position, thus anchoring both post and sleeve in the ground.

10 Claims, 4 Drawing Sheets

EASILY INSTALLABLE PROTECTIVE SLEEVE FOR AN EMBEDDED WOODEN POST REQUIRING UPLIFT CAPABILITY

CROSS REFERENCE TO RELATED APPLICATIONS

This application claims the benefit of priority to U.S. Provisional Patent Application entitled "EASILY INSTALLABLE PROTECTIVE SLEEVE FOR AN EMBEDDED WOODEN POST REQUIRING UPLIFT CAPABILITY", Ser. No. 61/714,702, filed on Oct. 16, 2012.

BACKGROUND OF THE INVENTION

This invention relates generally to construction methods using wooden posts or columns that are embedded in the earth, and more particularly to an easily installed protective sleeve for the embedded portion of a wooden post that enables installation in applications require uplift resistance capability.

Because these wooden posts are embedded into the earth, they are prone to decay at or below the ground line during the life of the post. The rapidity of the decay is generally dependent upon many factors, among them climate and soil conditions.

Post-frame buildings originated from pole barns and are becoming increasingly popular today for a wide variety of agricultural, commercial, and industrial purposes since they are, compared to many other types of construction, relatively simple and inexpensive to erect. Conventional post-frame buildings use vertical load bearing wooden posts having their lower ends buried in the earth and their upper ends integrated into the building frame. Suitable footing for the wooden poles is necessary to withstand downward forces from the weight of the building. At one time, holes were backfilled with compacted earth to maintain the post vertically plumb while the building frame was constructed and also to provide a stable foundation for the completed building. However, increasing building demands on foundations now typically require concrete backfill to provide sufficient foundation strength.

Because these wooden posts are embedded into the earth, they are prone to decay at or below the ground line during the life of the post. The rapidity of the decay is generally dependent upon many factors, among them climate and soil conditions. Concrete is known to neutralize many wood-preservative chemicals, promote wood decay, and weaken the structural integrity of wood. An increasingly popular solution in light of costs, environmental risks, and limitations of wood post chemical treatment is the application of protective covers or other water-impermeable media to the embedded portion of the post.

An additional problem facing post-frame construction is the need to provide a more secure anchorage for the post, specifically post anchorages capable of withstanding substantial uplift forces that may be imposed upon the building structure. Protrusions may be affixed to the post or steel rod inserted through bores in the post to enhance the foundation capability of embedded posts in response to this requirement. Such methods reduce the effectiveness of preservative treatments, which are most effective near the external surface of the wooden post. In cases when protective sleeves are employed, any perforation of the protective layer creates a pathway for moisture to reach the wooden post and lead to post deterioration, an especially important consideration since protective sleeves are typically used in lieu of preservative treatment of the wood.

What is needed is an improved wooden post protector that allows for easy post insertion, protects wooden posts against conditions that promote post deterioration, and at the same time provides increased resistance to post uplifting or downpressing displacing forces.

SUMMARY OF THE INVENTION

Accordingly, the present invention, in any of the embodiments described herein, may provide one or more of the following advantages:

It is therefore an object of the present invention to provide an improved wood post protective sleeve that protects the embedded post against conditions that promote post deterioration. A plastic sleeve is molded to conform to the exterior dimensions of the post and extends from one end for at least a length exceeding the desired embedment. The sleeve is unperforated other than an opening to receive the post to eliminate any risk of moisture intrusion into the wood through the sleeve. Once installed, the gap between the wooden post and the top of the protective sleeve is sealed to prevent moisture from entering the space between the post exterior and the sleeve.

It is another object of the present invention to provide an improved wood post protective sleeve that protects the embedded post against conditions that promote post deterioration while providing increased resistance to uplifting or downward displacing forces placed upon the post. A plastic sleeve is molded to conform to the exterior dimensions of the post and extends from one end for at least a length exceeding the desired embedment. It is known to increase the pullout resistance of an embedded post by including one or more inwardly concave notches into the exterior surface of a post. U.S. Pat. No. 7,506,859 to Keller discloses one such method. The wooden post of the present invention is provided with at least one notch project inwardly into the exterior surface of the post. The plastic sleeve includes one or more reversible snap domes molded into the surface and aligned with the notch in the wooden post when the post is inserted into the sleeve. The snap dome may flex to an outwardly concave position as the post is being inserted into the sleeve and then snapped to into an inwardly concave position once the post is fully installed. The inward concavity of the snap dome projects into the notch in the post to prevent the sleeve from being removed from the post. Once the post is embedded in the ground, the backfill material prevents the snap dome from being deflected into the outward concavity position, thus preventing anchoring both post and sleeve in the ground.

It is another object of the present invention to provide an easily installable wood post protective sleeve that protects the embedded post against conditions that promote post deterioration while providing increased resistance to uplifting or downward displacing forces placed upon the post. One or more inwardly projecting notches are cut into the portion of a wooden post that is to be embedded. A plastic sleeve is molded to conform to the exterior dimensions of the post and a reversible snap dome molded into the sleeve at locations coinciding with the notches in the post when the sleeve is installed. The snap dome may flex to an outwardly concave position as the post is being inserted into the sleeve and then snapped to into an inwardly concave position once the post is fully installed. The inward concavity of the snap dome projects into the notch in the post to prevent the sleeve from being removed from the post. Once the sleeve is installed, the gap between the wooden post and the top of the protective sleeve is sealed to prevent moisture from entering the space between the post exterior and the sleeve.

It is still another object of the present invention to provide an improved wood post protective sleeve for protecting an embedded post against conditions that promote post deterioration while providing increased resistance to uplifting or downward displacing forces placed upon the post that is durable in construction, inexpensive of manufacture, carefree of maintenance, easily assembled, and simple and effective to use.

It is yet another object of the present invention to provide a protective sleeve for an embedded post that may be easily axially secured to the post in a position that protects the most vulnerable portions of the post from deterioration. In an alternate embodiment, a sleeve comprising at least one side wall surrounds a post, covering at least the portion of the post transitioning from embedded to extending above the ground. An anchoring structure molded into the sleeve secures the sleeve to the post to prevent axial displacement of the sleeve as the post is being embedded in the ground.

These and other objects are achieved in accordance with the present invention by providing an improved wood post protective sleeve that protects the embedded post against conditions that promote post deterioration while providing increased resistance to uplifting or downward displacing forces placed upon the post. The plastic sleeve is molded to conform to the exterior dimensions of the post and extends from one end for at least a length exceeding the desired embedment. The sleeve is unperforated other than an opening to receive the post to eliminate any risk of moisture intrusion into the wood through the sleeve. One or more inwardly projecting notches are cut into the portion of a wooden post that is to be embedded. The plastic sleeve includes at least one reversible snap dome molded into the sleeve at a location coinciding with the notch in the post when the sleeve is installed. The snap dome may flex to an outwardly concave position as the post is being inserted into the sleeve and then snapped to into an inwardly concave position once the post is fully installed. The inward concavity of the snap dome projects into the notch in the post to prevent the sleeve from being removed from the post. Once the sleeve is installed, the gap between the wooden post and the top of the protective sleeve is sealed to prevent moisture from entering the space between the post exterior and the sleeve. When embedded into the ground, backfill material prevents the snap dome from being deflected into the outward concavity position, thus anchoring both post and sleeve in the ground.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined from a vantage on level ground with an embedded post projecting upwardly therefrom. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
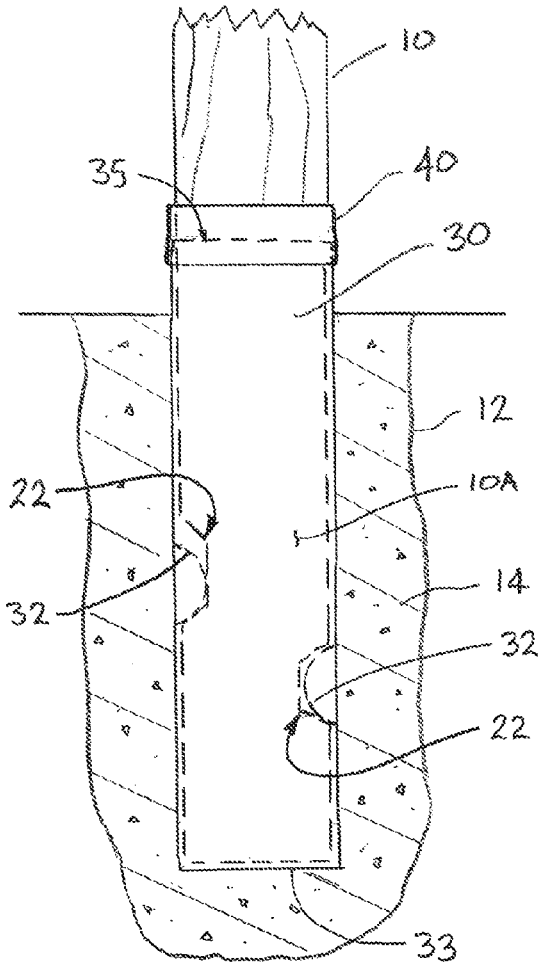
FIG. 1 is an elevation view of a typical ground-embedded post of the type on which the invention is useful showing a first embodiment of the invention.

Referring to the Figures and more particularly to FIG. 1, a post 10 is shown in elevation. Post 10 is typical of the posts used as vertical support columns for the erection of wood frame structures and features nominal cross sections ranging from 4 inches by 4 inches to 6 inches by 8 inches. Posts in such wood frame construction are recessed inwardly sufficiently from the perimeter of the structure or are sheltered at the interior side of an adjacent wall to be in a dry environment thus permitting the use of untreated wood. The post 10 is positioned in a hole 12 and embedded in a backfill material 14, typically a cementitious material, to retain the post in position extending generally vertically upward from the hole 12 and provide a stable and secure footing for the structure. The hole may extend downwardly below the frost line which may be on the order of 42 or 48 inches to provide a secure stable footing and the post may extend ten feet or more above ground level as may be required by the design of a particular structure.

Figure 2:
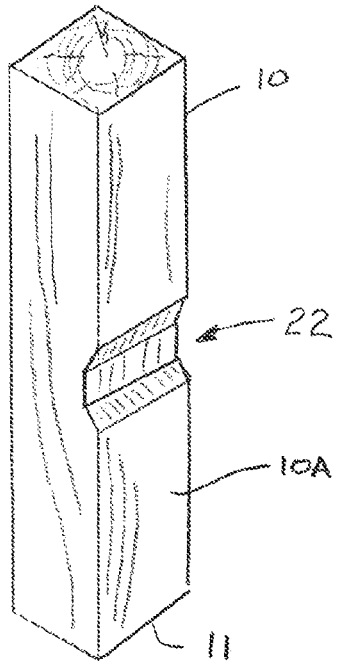
FIG. 2 is a perspective view of a typical post for embedment in the ground having a recess in the exterior surface to receive the anchor structure of the present invention.
Figure 3:
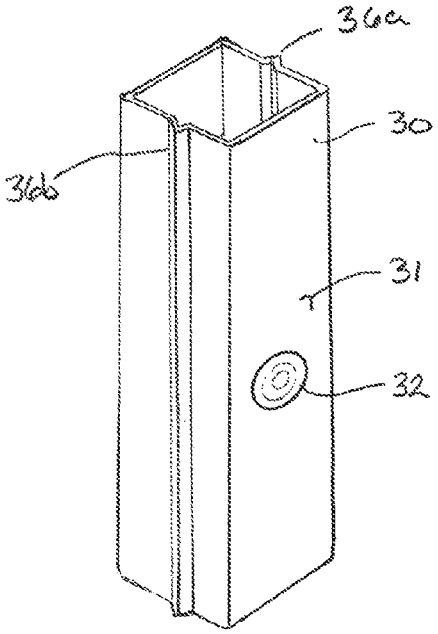
FIG. 3 is a perspective view of a protective sleeve for an embedded post having an anchor structure of the present invention.

Now referring to FIGS. 1 through 3, a plastic casing or sleeve 30 is provided to cover the lower portion 10A of post 10 to prevent the post material from direct contact with the backfill material 14. In the preferred embodiment, the sleeve comprises at least one side wall 31 and an integrally formed floor 33. There are no penetrations or perforations in the sleeve except for the opening at the top end 35 to receive the post 10. The sleeve 30 may be formed from low density polyethylene (LDPE), high density polyethylene (HDPE) or polyvinyl chloride (vinyl or PVC). Other materials offering similar lifespan and water impermeability may also be used, subject to the limitations of the anchorage structure discussed later herein. The sleeve 30 is molded to conform to the exterior dimensions of the lower portion 10A of post 10 with minimally sufficient clearance to allow the sleeve to slide over the post end until the post is fully inserted into the sleeve.

Figure 6:
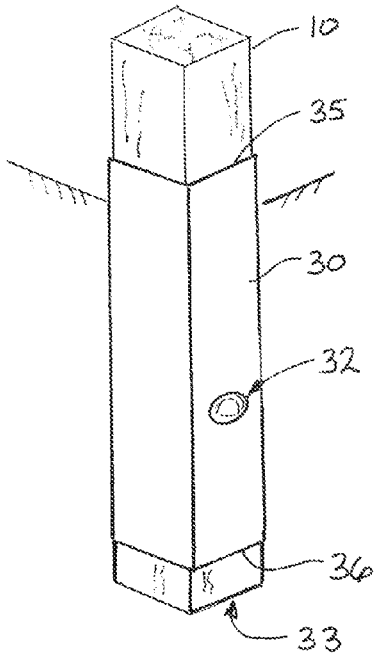
FIG. 6 is a partial perspective view of a second embodiment of the protective sleeve and anchor of the present invention.

In an alternate embodiment shown in FIG. 6, a sleeve 30 comprising at least one side wall for surrounding the post with a top opening defined by top end 35 and a bottom opening defined by lower end 36 which allows the sleeve 30 to slide axially over the post 10 and be positioned to cover the majority of the end portion of the post to be embedded. The lack of a floor in this embodiment is less detrimental as the post end adjacent to the floor is typically embedded in concrete where exposure to water and air is minimal and thus minimizing wood deterioration. The open bottom of the sleeve also allows legs or other apparatus to elevate the bottom end 33 of the post above the bottom of the post hole so that the backfill material may flow beneath the post end to provide an adequate foundation.

The sleeve material wall thickness is sufficient to prevent perforation of the sleeve during normal material handling, post insertion, and post placement into the post holes. Wall thickness may vary depending upon location around the perimeter of the post due to the molding process. Wall thicknesses ranging from 1/16-inch to 1/8-inch are preferred as providing an acceptable balance between durability and flexibility.

The sleeve 30 length exceeds the planned embedment depth for the post by an amount sufficient to allow the top end 35 of the sleeve 30 to project above the grade elevation when the post is installed so that no deterioration of the embedded post portion due to the ground contact occurs, especially at the ground surface. The transition of an embedded wooden post from ground embedment to free air represents the most post portion most vulnerable to deterioration as the wood is exposed to both air and moisture. The sleeve length may be trimmed following installation, if desired, to avoid an excessive length extending above the grade line.

The sleeve may be provided with outwardly projecting, vertically aligned V-shape vent channels 36*a*, 36*b* on opposing sides of the sleeve. The vent channels 36*a*, 36*b* provide an exhaust path for any air which might otherwise become trapped between the bottom 11 of the post 10 and the bottom 33 of the sleeve as the post is inserted. The vent channels 36*a*, 36*b* also provide for slight expansion of the sleeve to accommodate variations in post exterior dimensions (e.g., dimensional tolerances).

Figure 4:
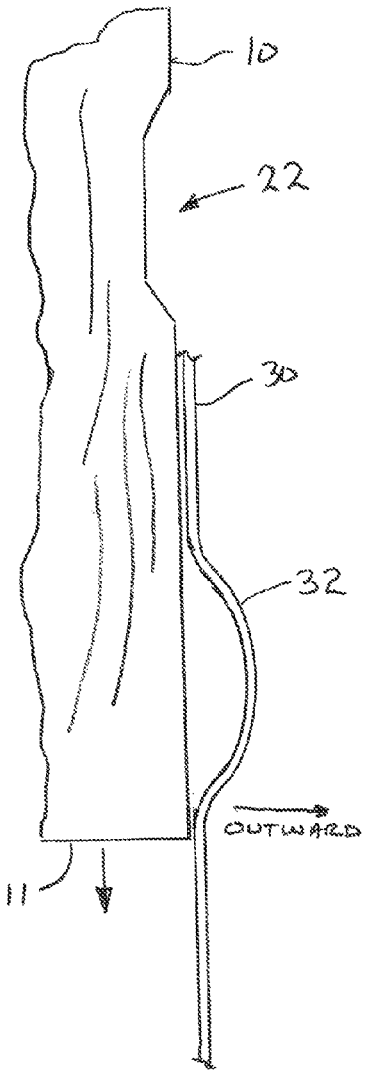
FIG. 4 is a partial side elevation view of the post and sleeve with the anchor structure shown as it would be configured during installation of the sleeve.
Figure 5:
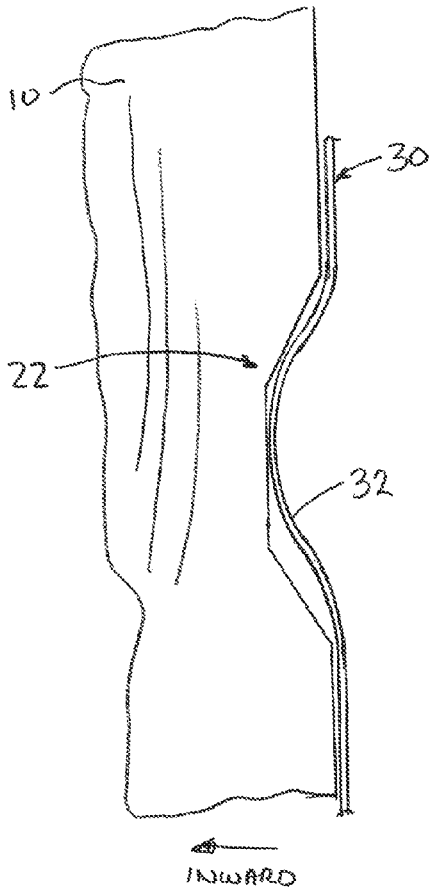
FIG. 5 is a partial side elevation view of the post and sleeve of FIG. 5 wherein the sleeve and anchor are configured as would be for embedment in the ground.

Finally referring to all of the figures, but FIGS. 4, 5, 7 and 8 specifically, a recess 22 is provided in post 10 to allow for post anchorage. Cementitious backfill material engaging an inwardly projecting recess is known to increase the uplift or pull-out resistance of such posts. Sleeve 30 is secured to the post 10 by one or more anchor members 32 molded into the side walls 31 of the sleeve 30. The anchor members 32 are preferably snap domes molded in the side wall so that the dome 32 normally projects inwardly (FIG. 5) or outwardly (FIG. 4). Such structures are well-known in molded plastics, commonly used in smaller form on plastic drink cup lids as a means to indicate the contents of the cup. An inwardly projecting normal position is preferred for packaging efficiency. The molding process thins the sleeve wall slightly in the area of the dome allowing the dome to be pushed between the inward and outward projecting positions, normally by hand. As the post 10 is inserted into the sleeve, contact between the post end 11 and the snap dome 32 will force the snap dome outwardly, allowing the post to continue to be inserted. Once the post is inserted, the snap dome 32 may be pushed inwardly so that it projects into the recess 22 in the post. For sleeves having a normally outward projecting snap dome (FIG. 4), the snap dome may be pushed inwardly to engage the post recess 22 once the post 10 is fully inserted into the sleeve 30.

Figure 7:
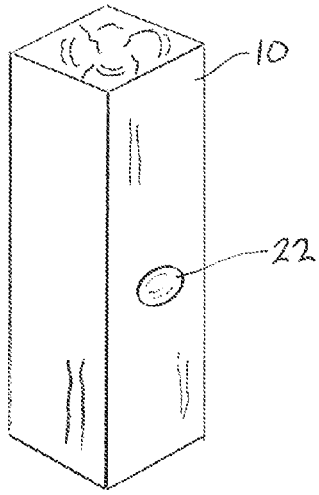
FIGS. 7 and 8 illustrate a first embodiment of a recess formed in a post for engagement by the anchor member of the present invention.
Figure 8:
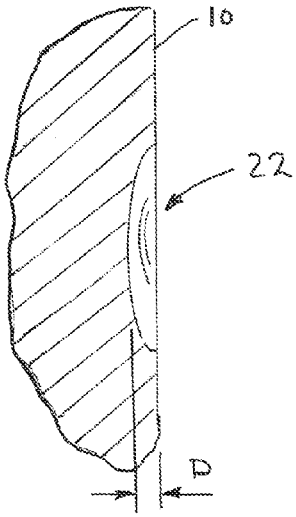
Figure 9:
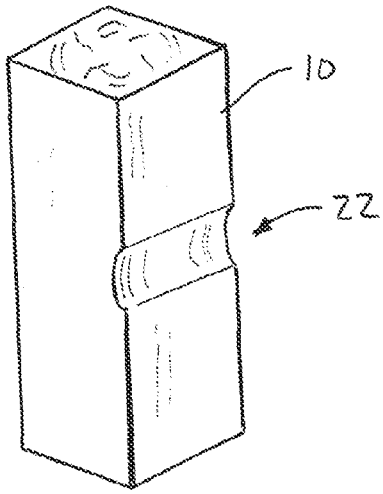
FIGS. 9 and 10 illustrate a second embodiment of a recess formed in a post for engagement by the anchor member of the present invention.
Figure 10:
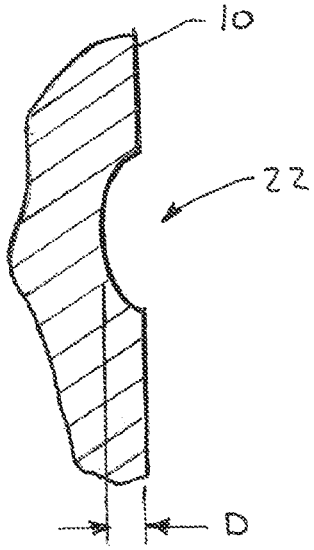

The post recess 22 may be formed by linear cuts to form an inwardly projecting notch (a trapezoidal shape is illustrated in FIGS. 1 through 5), a generally circular recess matching the arcuate contours of the molded snap dome 32, shown in FIGS. 7 and 8, or an arcuate recess extending across the face of the post as shown in FIGS. 9 and 10. The depth of the recess, illustrated as dimension "D" must be sufficient to enable the snap dome to extend at least partially inwardly into the recess. In the preferred embodiment wherein the sleeve is used to anchor the post into the ground, the recess depth "D" is approximately one-half inch. Greater depth is permissible provided post integrity is not compromised. Lesser depth is also permissible for applications requiring less pull-out resistance by the anchor.

Figure 11:
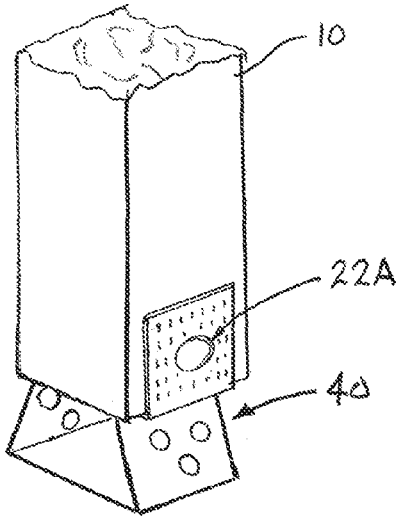
FIGS. 11 and 12 illustrate the protective sleeve embodiment shown in FIG. 6 and a third embodiment of a post recess used for engaging the anchor member.
Figure 12:
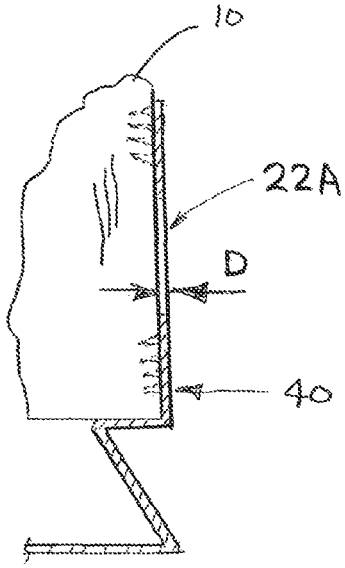

In yet another embodiment as illustrated in FIGS. 11 and 12, an attached anchoring or post support member 40 is attached to opposing faces of the post 10. One such support member 40 is disclosed in U.S. application Ser. No. 13/359,543 to Keller, the descriptive portion being incorporated herein by reference. Testing has demonstrated that the vertical support attached as a "pillblock" replacement also provides significant vertical uplift resistance. Due to the arrangement, the uplift forces are transferred directly from the support to the post, reducing the axial force resistance necessary between the post and the sleeve. An aperture 22A drilled into at least one of the plate portions of the support member 40 in adjacent contact with the post surface provides sufficient engagement for the snap dome 32 to engage and retain the sleeve in position on the post. This arrangement is especially useful for open-bottom sleeves as previously discussed in reference to FIG. 6 and similar installations for which the anchor member 30 need only retain the sleeve.

With the sleeve 30 installed on the post and the snap dome 32 depressed to engage the post notch 22, the post may be set into position. Cementitious backfill material will fill the snap dome recess and prevent the snap dome from being moved from the inwardly projecting position. In this manner, the post 10 is engaged with the protective sleeve 30 and the sleeve 30 is engaged with the backfill 14 and neither post nor sleeve may be easily removed. Moreover, the sleeve is anchored in the post hole while remaining unperforated; contact between the ground and the wooden post is prevented.

The number of snap domes 32 and notches 22 may be varied to suit the required uplift resistance of the post installation. On sleeves incorporating the V-shaped vents 36*a*, 36*b*, snap domes placement is limited to the opposing faces not incorporating the vents.

Posts are normally positioned on the building structure interior. In order to assure that moisture does not enter the interior of the sleeve 30, a top seal 35 may be provided once the post is inserted into the sleeve. The top seal may be a gasket, an elastomeric band encircling the joint, a sealed wrap, a caulk bead, or any other sealing method to prevent moisture from migrating down the side face of the post and collecting in the sleeve.

Naturally, the invention is not limited to the foregoing embodiments, but it can also be modified in many ways without departing from the basic concepts. It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A protective system comprising:

a lower post portion having at least one inwardly oriented recess;

a sleeve having at least one side wall and an upper opening exposing an interior cavity, the interior cavity being fitted to the outside shape and dimension of the lower post portion; and at least one anchor member integrally formed in the at least one side wall, the anchor member having a generally dome-shaped structure projecting from the at least one side wall, the dome-shaped structure being flexibly moveable between generally opposing first and second positions, the dome-shaped structure projecting into the interior cavity when in the first position, the dome-shaped structure projecting outwardly from the interior cavity when in the second position, the dome-shaped structure being biased toward the first position and extending into the recess when the post is positioned within the sleeve to inhibit retraction of the post from the sleeve.

2. The protective system of claim 1, wherein the sleeve further includes a floor at an end opposite of the upper opening.

3. The protective system of claim 2, wherein the sleeve is formed from a resilient material.

4. The protective system of claim 3, wherein the at least one side wall and floor form a continuous barrier surrounding the lower portion.

5. The protective system of claim 4, wherein the continuous barrier is water impervious.

6. The protective system of claim 5, further comprising at least one vent channel disposed in the at least one side wall to permit air to escape from the interior cavity as the lower portion of the post is inserted into the sleeve.

7. A method for protecting and anchoring a lower portion of a post into the ground comprising the steps of:

providing a post for embedment in the ground, the post having a lower portion and at least one inwardly oriented recess;

providing a sleeve having at least one side wall and an upper opening exposing an interior cavity, the interior cavity being fitted to the outside shape and dimension of the lower post portion, the sleeve being formed from a resilient material;

providing at least one anchor member integrally formed in the at least one side wall, the anchor member having a generally dome-shaped structure projecting from the at least one side wall, the dome-shaped structure being flexibly moveable between generally opposing first and second positions, the dome-shaped structure projecting into the interior cavity when in the first position, the dome-shaped structure projecting outwardly from the interior cavity when in the second position;

moving by flexing the at least one anchor member into the second position;

inserting the lower portion into the sleeve and aligning the at least one anchor member with the at least one recess on the post; and moving by flexing the dome-shaped structure of the at least one anchor member into the first position such that the protrusion at least partially extends into the at least one recess.

8. The method of claim 7, further comprising the step of:

providing a floor in the sleeve at an end opposite of the upper opening, the floor and the at least one side wall forming a continuous, water impervious barrier surrounding the lower portion of the post.

9. The method of claim 8, further comprising the steps of:

positioning the lower portion of the post in a hole in the ground; and introducing a backfill material into the hole, the backfill material preventing the arcuate protrusion from moving from the first position toward the second position, thereby securing both the sleeve and the post in the backfill material.

10. The method of claim 9 further comprising the steps of:

biasing the dome-shaped structure toward the first position;

inserting the post into the sleeve, contact between the lower portion and interior surface of the dome-shaped structure forcing the structure to flex toward the second position; and aligning the at least one anchor member with the at least one recess on the post enabling the dome-shaped structure to return to the first position and at least partially extend into the at least one recess.

* * * * *